US005547355A

United States Patent [19]

Watanabe et al.

[11] Patent Number: 5,547,355

[45] Date of Patent: Aug. 20, 1996

[54] SCROLL TYPE MACHINE HAVING MEANS TO PREVENT OR SUPPRESS DEFLECTION OF LEGS OF SCROLL-SUPPORTING FRAME

[75] Inventors: Kazuhide Watanabe; Kimiharu Takada, both of Nishi-Kasugai-gun; Masumi Sekita, Nagoya; Takahide Ito, Nagoya; Kazuya Tani, Nagoya, all of Japan

[73] Assignee: Mitsubishi Jukogyo Kabushiki Kaisha, Tokyo, Japan

[21] Appl. No.: 381,561

[22] Filed: Jan. 31, 1995

[30] Foreign Application Priority Data

Feb. 1, 1994 [JP] Japan ..... 6-010414
Feb. 4, 1994 [JP] Japan ..... 6-012597

[51] Int. Cl.[6] ..... F01C 1/04

[52] U.S. Cl. ..... 418/55.5; 418/57; 29/888.022

[58] Field of Search ..... 418/55.5, 57; 29/888.022

[56] References Cited

U.S. PATENT DOCUMENTS 5,102,316 4/1992 Caillat et al. ..... 418/55.5

FOREIGN PATENT DOCUMENTS 3237283 10/1991 Japan ..... 418/55.5

*Primary Examiner*—John J. Vrablik
*Attorney, Agent, or Firm*—Wenderoth, Lind & Ponack

[57] ABSTRACT

A scroll machine has a sealed housing divided into a high-pressure side and a low-pressure side by a discharge cover, a stationary scroll and a swivel scroll housing within the low-pressure side of the sealed housing, a frame with legs fixed within the sealed housing, a support spring through which the stationary scroll is attached to the top ends of the legs of the frame, and an intermediate pressure chamber formed by sealingly engaged parts of the rear portion of the stationary scroll and an inner surface of the discharge cover so that the stationary scroll will be pressed against the swivel scroll by hydraulic pressure introduced into the intermediate pressure chamber. The frame is plug-welded to the sealed housing at a plurality of points lying along the outer circumferences of the legs of the frame, the top ends of the legs of the frame are connected to each other with a reinforcing plate or the legs are fitted to the inner surface of the housing, so as to prevent lateral displacement of the stationary scroll and the breakage of sealing members at the parts defining the intermediate pressure chamber.

8 Claims, 8 Drawing Sheets

SCROLL TYPE MACHINE HAVING MEANS TO PREVENT OR SUPPRESS DEFLECTION OF LEGS OF SCROLL-SUPPORTING FRAME

BACKGROUND OF THE INVENTION

1. Field of the Invention

The present invention relates to a scroll type machine to be used as a compressor or an expander.

2. Prior Art

As a prior art example, a conventional scroll compressor will be described by referring to the accompanying drawings, especially FIGS. 12 and 13 of which the former is a vertical sectional view of the scroll type compressor and the latter is a sectional view taken along XIII—XIII of the former. As shown a sealed housing 8 is internally divided into a high-pressure chamber 44 and a low-pressure chamber 45 by a discharge cover 31. Within the low-pressure chamber there are provided at the upper and lower parts thereof, respectively, a scroll type compression mechanism C and a motor M which are coupled together through a rotary shaft 5 in an interlocking relationship with each other. The motor M comprises a rotor Ma and a stator Mb of which the former is fixed to a rotary shaft 5 and the latter is fixed to the sealed housing 8. The upper end of the rotary shaft 5 is supported by an upper bearing 71 provided on a frame 6 and the lower end thereof is supported by a lower bearing 72.

The scroll type compression mechanism C is provided with a stationary scroll 1 and a swivel scroll 2. The stationary scroll 1 is provided with an end plate 11, at the central part of which a discharge part 13 is provided, and a spiral wrap 12 erected on the internal surface of the end plate 11. The swivel scroll 2 is provided with an end plate 21 and a spiral wrap 22 erected on the internal surface of the end plate 21. Further, within a boss 23 erected on the outer surface of the end plate 21 there is rotatably received a drive bush 54 through a swivel bearing 73, and an eccentric pin 53 projecting from the upper end of the rotary shaft 5 is slidably fitted into a slide hole 55 drilled in the drive bush 54.

The stationary scroll 1 and the swivel scroll 2 are eccentric from each other by a predetermined amount so that when they are caused to mesh with each other as they are shifted by an angle of 180°, the side surfaces of the spiral wraps 12 and 22 are held in line-contact with each other at several points thereby providing a plurality of sealed spaces 24 therebetween. The swivel scroll 2 is slidably supported on the frame 6 fixed in the sealed housing 8, and between the swivel scroll 2 and the frame 6 there is arranged a rotation checking mechanism 3 comprising an Oldham's link or the like which, while allowing the revolutional motion of the swivel scroll 2, inhibits the rotation of the swivel scroll on its own axis.

Between two flanges 14 formed on the outer peripheral surface of the stationary scroll and four legs **6*b* projecting from an end plate 62 of the frame 6 there is arranged a ringlike support spring 32 made of a thin plate. As shown in FIG. 13, the support spring 32 is clamped to the flanges 14 by means of four bolts 36 and to the legs 6*b* by means of four bolts 37. Thus, the stationary scroll 1 is floatably supported on the frame 6 through the support spring 32** so that the stationary scroll can move vertically within a predetermined range and can incline within a predetermined angle.

On the rear surface of the end plate 11 of the stationary scroll 1 there are erected upright two concentric cylindrical flanges 15 and 16 which are concentric with the end plate 11. A cylindrical flange 38 projecting downward from the lower surface of the discharge cover 31 is sealingly and slidably fitted between the two cylindrical flanges 15 and 16 through U-shaped ringlike sealing members 74 and 75 which are respectively disposed in two gaps formed between the fitting surfaces of the flanges 15, 16 and 38 thereby forming an intermediate pressure chamber 40. The intermediate pressure chamber 40 is in communication with a sealed space 24 located midway in a gas compression passage through a lead hole 41 extending through the end plate 11. Further, on the inner peripheral side of the intermediate pressure chamber 40 there is formed a high-pressure chamber 42 and on the outer peripheral side thereof there is formed a low-pressure chamber 43.

In this type of compressor, when the motor M is driven, the swivel scroll 2 is driven by a swivel mechanism comprising the rotary shaft 5, the eccentric pin 53, the drive bush 54, the boss 23, etc. so that the swivel scroll 2 makes a circular orbit while it is hindered from rotating about its own axis. Then, with the motion of the swivel scroll, the gas enters the low-pressure chamber 45 through a gas intake pipe 82 and after passing along a path 61 between the sealed housing 8 and the end plate 62 of the frame 6, it is sucked into a sealed space 24 from the low-pressure chamber 43. Then, with a decrease in the volume of the sealed space 24 caused by the revolutional motion of the swivel scroll 2, the gas reaches the central portion of the machine as it is compressed, enters the high-pressure side 44 via the discharge port 13 provided at the center of the stationary scroll 1 and the high-pressure chamber 42 and is discharged outside through a discharge pipe 83.

In this case, a back pressure load based on the gas pressure in the high-pressure chamber 42 and the intermediate pressure chamber 40 is applied on the stationary scroll 1 so that the stationary scroll 1 is pressed against the swivel scroll 2 thereby preventing the leakage of the gas from within the sealed space 24. When a liquid is sucked into the sealed space 24, the stationary scroll 1 floats up through the support spring 32 to discharge the liquid thereby preventing the scroll type compression mechanism from getting damaged. Further, when the swivel scroll 2 inclines, the scroll 1 inclines through the support spring 32 so as to follow the scroll 2 so that both of the swivel scroll 2 and the stationary scroll 1 are prevented from being brought into partial contact with each other.

As described above, in the case of the conventional scroll type machine, the frame 6 is inserted into, and positioned properly in, the sealed housing 8 as shown in FIG. 14 and then fixed at a plurality of points on the outer periphery of the end plate 62 thereof by plug-welding W. Further, because the outer diameter of the frame 6 is somewhat smaller than the inner diameter of the sealed housing 8, a minute clearance $\epsilon$ is formed at the top of each of the four legs **6*b*. Consequently, the four legs 6*b* are considered to act as cantilever beams making the plug-welded points (i.e., the outer periphery of the end plate 62) their fulcrum points and therefore, during the operation of the compressor, the top ends of the legs 6*b* flex due to a compression force, centrifugal force and etc. Note that each of the legs 6*b* is set higher than a bottom surface 12*a* of the spiral wrap 12**.

With the above structure, when the capacity of the compressor is large, the heights of the spiral wraps 12 and 22 tend to also be large and so will the height of each leg b. The amount of deflection of the top end of each leg **6*b* is proportional to the third power of the distance L (refer to FIG. 14) from the fulcrum so that the height of each leg 6*b*** must be made increasingly large the larger the capacity of the compressor becomes.

When the top end of each of the legs 6*b* deflects, the stationary scroll 1 displaces horizontally through the support spring 32 whereupon the gaps between the fitting surfaces of the cylindrical flanges 15 and 16 projecting from the rear surface of the stationary scroll 1 and the cylindrical flange 38 projecting from the lower surface of the discharge cover change.

In the above case, there has hitherto been a problem in that although no difficulty takes place when the top end of each of the legs 6*b* deflects only a little and the above gaps change a little, if the deflection of the top end of each leg 6*b* is so large as to increase the gaps, an excessive compression load is repeatedly applied on the sealing members 74 and 75 disposed in the gaps resulting in damage to the sealing members.

SUMMARY OF THE INVENTION

The present invention has been made to eliminate the above-described disadvantages of the prior art technology. That is, the present invention aims at reducing or eliminating the deflection of the top ends of the legs of the frame, reducing the horizontal displacement of the stationary scroll, and thereby preventing the sealing member of the intermediate pressure chamber from being subjected to an excessive load and from getting damaged.

According to the present invention, there is provided a scroll machine having a sealed housing divided into a high-pressure side and a low-pressure side by a discharge cover, a stationary scroll and a swivel scroll housed in the low-pressure side so as to mesh with each other, a frame having legs fixed in the sealed housing, the stationary scroll is attached to the top ends of the legs of the frame by means of a support spring, an intermediate pressure chamber formed by a part of the rear surface of the stationary scroll and a part of the inner surface of the discharge cover engaging one another in a sealed state, the stationary scroll being pressed against the swivel scroll by a fluid pressure introduced into the intermediate pressure chamber in the course of compression. The scroll hydraulic machine of the present invention may be characterized as follows:

(1) the frame is fixed within the sealed housing at a plurality of points along the circumference of the leg portions of the frame by plug-welding;

(2) that the frame is fixed to the sealed housing at the legs thereof and at a plurality of points along the outer periphery of the end plate thereof by plug-welding;

(3) the frame is inserted into the sealed housing in a state in which the housing is heated to expand and then the housing is cooled to contract so that the frame including its legs is fixed to the housing with the entire outer periphery of the frame being in pressure contact with the inner surface of the housing;

(4) the frame is fixed to the sealed housing by press fitting the frame with its legs into the housing;

(5) the top ends of the legs of the frame are connected to each other by a reinforcing plate;

(6) the reinforcing plate mentioned in the preceding paragraph 5 is in the form of a ring;

(7) the ringlike reinforcing plate is press-fitted lightly into the sealed housing and the top ends of the legs of the frame are fixed to the reinforcing plate; or (8) a set of upper and lower clamping members having inclined surfaces capable of coming into sliding contact with each other are fastened to the top end of each of the legs of the frame and in the course of clamping these members together with a clamping bolt, the upper clamping member is caused to slide outwardly along the tapered surface of the lower clamping member so as to be brought into close contact with the inner surface of the sealed housing.

Due to having the above-described characteristics, the present invention can have following various advantages:

In the present invention described in the above paragraph 1, the plug-welding points are on the outer periphery of each of the legs of the frame and when the leg supporting structure is considered to be a cantilever, the fulcrum of the cantilever is the leg welding point making the length of the cantilever shorter than that of the conventional machine so that the amount of deflection of the top end of each leg can be comparatively less.

In the present invention described in the above paragraph 2, the plug-welding points are on the outer periphery of the end plate of the frame and on the inner circumference of the sealed housing and each of the legs of the frame is fixed to the sealed housing by plug-welding at the upper and lower points. Since the frame structure is supported at both ends, the deflection of the top end of each of the legs of the frame can be completely suppressed.

In the present invention described in the above paragraphs 3 and 4, because the entire outer peripheral surface of the frame, including the legs, is held in pressure contact with the inner surface of the sealed housing, the deflection of the top end of each of the legs is suppressed.

In the present invention described in the above paragraph 5, since the top ends of the legs of the frame are connected to one another by the reinforcing plate, the rigidity of the legs of the frame is improved thereby reducing the possible deflection of the legs and as a result, no excessive compression load is applied at the sealed engagement of the stationary scroll and discharge cover.

In the present invention described in the above paragraph 6, since the reinforcing plate connecting the top ends of the legs of the frame is in the shape of a ring, a rigid frame is formed by the legs, the end portion of the frame and the reinforcing plate thereby further enhancing the operation and effects of the machine.

In the present invention described in the above paragraph 7, since the top ends of the legs of the frame are fixed to the ring-shaped reinforcing plate press-fitted lightly into the housing, the deflection of each of the legs does not take place so that no compression load is applied at the sealed engagement.

Lastly, in the present invention described in the above paragraph 8, the top end of each of the legs of the frame is held in close contact with the inner surface of the housing through the clamping member. Accordingly, this invention can achieve a similar function and effect to those of the present invention described above in the paragraph 7.

As described above, in the present invention, it is possible to reduce or eliminate the deflection of top end of each leg, and as a result, the horizontal displacement of the stationary scroll through the support spring is likewise suppressed or inhibited so that a gap between the part of the rear surface of the stationary scroll and the part of the inner surface of the discharge forming the intermediate pressure chamber will not vary much at all during operation; whereby a sealing member disposed in this gap can be prevented from being subjected to an excessive compression load.

BRIEF DESCRIPTION OF THE DRAWINGS

FIG. 1(*b*) is a front view of the essential portion of the scroll compressor shown in FIG. 1(*a*);

FIG. 2(*b*) is a front view of the essential portion of the scroll compressor shown in FIG. 2;

FIG. 6(*b*) is a sectional view taken along the 6*b*—6*b* line of FIG. 6(*a*);

FIG. 9(*b*) is a sectional view taken along the 9*b*—9*b* line of FIG. 9(*a*);

FIG. 10(*b*) is a sectional view taken along line 10*b*—10*b* line of FIG. 10(*a*);

FIG. 11(*b*) is a sectional view taken along the 11*b*—11*b* line of FIG. 11(*a*);

FIG. 11(*c*) is a sectional view taken along the 11*c*—11*c* line of FIG. 11(*a*);

DETAILED DESCRIPTION OF THE PREFERRED EMBODIMENTS OF THE INVENTION

Figure 1A:
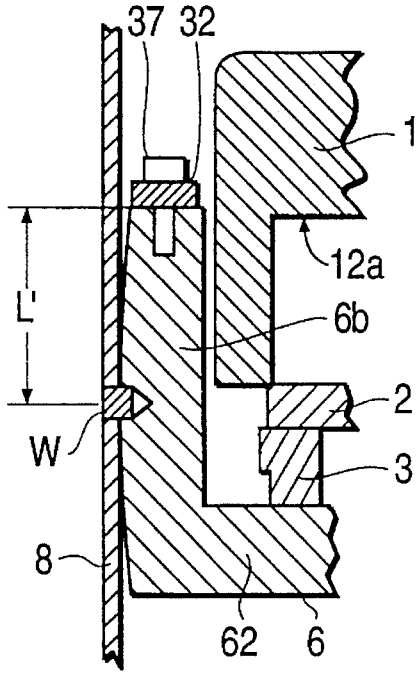
FIG. 1(*a*) is a vertical sectional view of the essential portion of one embodiment of a scroll compressor according to the present invention.
Figure 1B:
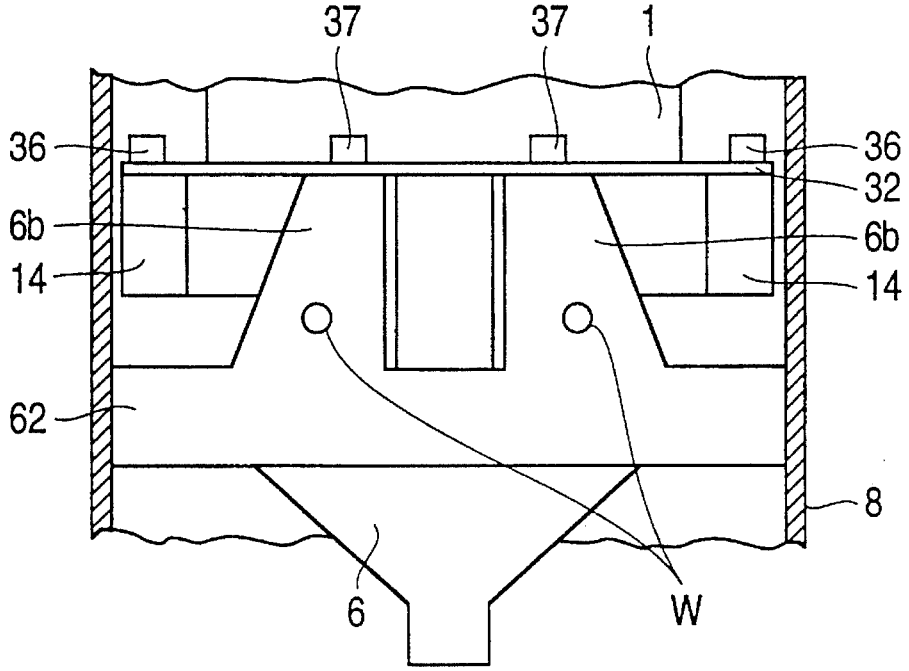

Referring to FIG. 1, reference symbol W designates one of plug-welded portions at which a frame is fixed to a sealed housing 8 in the first embodiment of the present invention. The frame 6 has a leg 6*b* and is fixedly mounted within the sealed housing 8 by plug-welding at a plurality of portions along the circumferential surface of the leg 6*b*.

Figure 14:
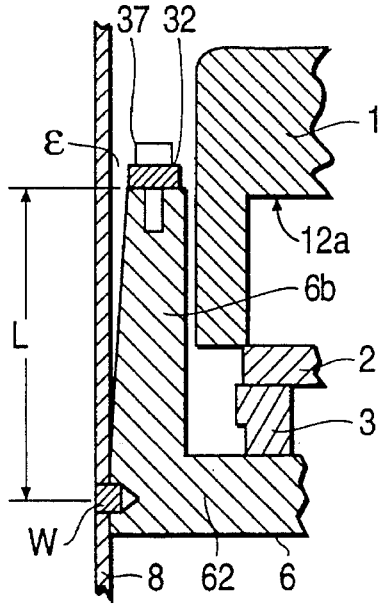
FIG. 14 PRIOR ART
FIG. 14 is a detailed partial vertical sectional view of the scroll compressor shown in FIG. 13.

Accordingly, when the leg supporting structure is considered to be a cantilever, the arm length from the plug-welding position as the fulcrum is reduced from L in the conventional case (cf. FIG. 14) to L' (cf. FIG. 6) and the deflection of the top end of the leg 16*b* is reduced. The structure and operation of the portions other of the compressor are the same as those of the conventional compressor.

Figure 2A:
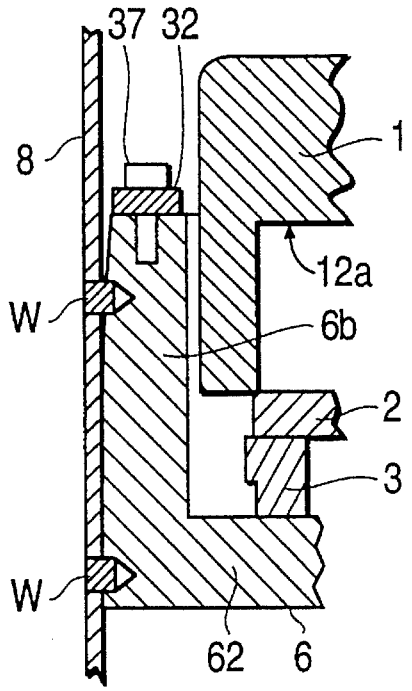
FIG. 2(*a*) is a vertical sectional view of the essential portion of a second embodiment of a scroll compressor according to the present invention.
Figure 2B:
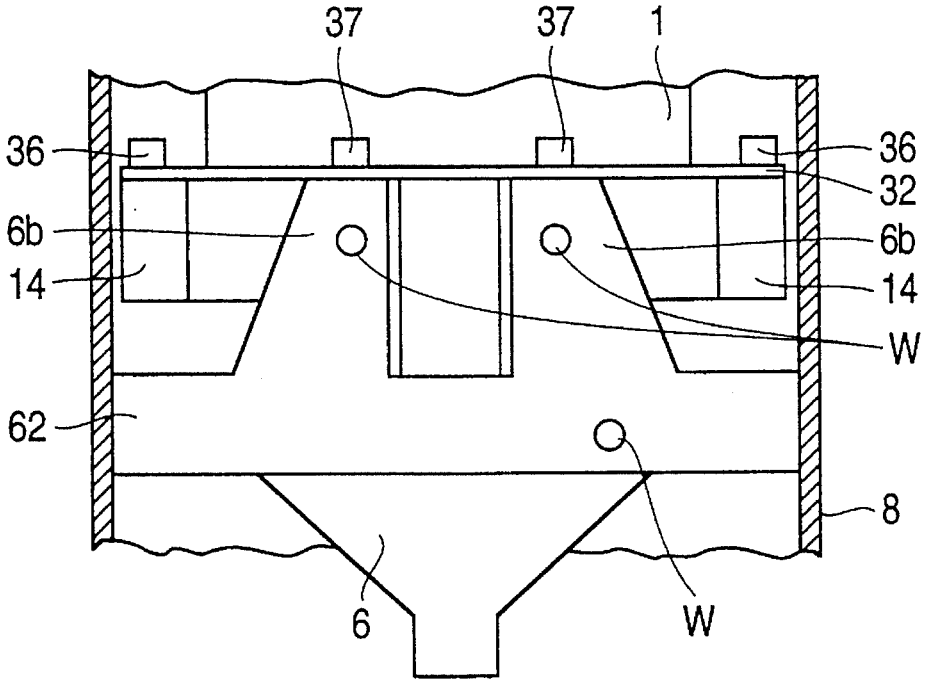

Referring to FIG. 2, reference symbol W designates one of plug-welded portions at which a frame 6 is fixed to a sealed housing 8, in the second embodiment of the present invention. The frame 6 has a leg 6*b* and is fixedly mounted within the sealed housing 8 by plug-welding at a plurality of portions at the outer peripheral surface of the end plate 62 and along the circumferential surface of the leg 6b. Accordingly, the frame 6 is supported by the leg 6*b* not in a cantilever fashion but at both ends so that almost no deflection of the top end of each leg 6*b* takes place. The structure and operation of the other portions of the compressor are the same as those of the conventional compressor.

Figure 3:
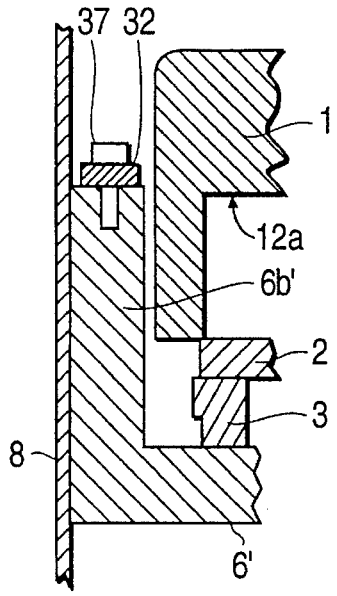
FIG. 3 is a vertical sectional view of the essential portion of a third embodiment of the scroll compressor according to the present invention.

FIG. 3 is a vertical sectional view of the essential portion of a third embodiment of a scroll compressor according to the present invention. In the prior art technology, the outer diameter of the frame 6 has been so determined as to provide a gap with the inner surface of the sealed housing 8, but in the instant embodiment, the outer diameter of a frame 61 is so determined as to provide suitable looseness with respect to the inner surface of the sealed housing 8. For example, the inner diameter of the sealed housing 8 is set to {–0.08, –0.18}, the outer diameter of the frame 6' is set to {+0.04, –0.03} and the looseness is set to 0.05–0.22 (all of the figures are in mm and the figures in the parentheses are tolerance values). Under such conditions, the sealed housing 8 is expanded by high-frequency heating and the frame 6' is inserted into the housing Then, after positioning the frame 6' the sealed housing is cooled by a blower to its normal temperature, that is, the frame 6' and the housing 8 are subjected to shrink-fitting. As a result, the frame 6' is held stationary within the sealed housing 8 by an interference fit and accordingly, the entire surface of the legs 6b' is tightly pressed against the sealed housing 8' thereby preventing the deflection of the top end of the leg 6*b'*.

As a fourth embodiment of the present invention, the frame 6' is press-fitted to the sealed housing 8. The operation and effects of the third embodiment can be with this embodiment, too.

In the above-described embodiments, the deflection of the top end of the leg of the frame can be reduced or completely suppressed by the following arrangements: when the leg support structure can be regarded as a cantilever, plug-welding points are provided at the outer circumference of the leg, so that the length of the arm (refer to L' in FIG. 1) is short compared to the prior art in which the conventional plug-welding points are provided at the outer periphery of the frame end plate (corresponding to the lower end of the leg); in addition to the conventional plug-welding points at the outer periphery of the frame end plate (the lower end of the leg), several plug-welding points are provided at the top end of each of the legs so that the leg-support structure has both; or the frame is shrink-fitted or press-fitted to the sealed housing and the entire surface of the frame including the legs is tightly pressed against the inner surface of the housing. Consequently, because the stationary scroll is not allowed to displace much horizontally via the support spring, the gap forming the intermediate pressure chamber provided when a part of the rear surface of the stationary scroll and a part of the inner surface of the discharge cover engage each other in a sealed state will not vary to a great extent so that no excessive compression load is applied to the sealing member thereby preventing the sealing member from being damaged.

Figure 4:
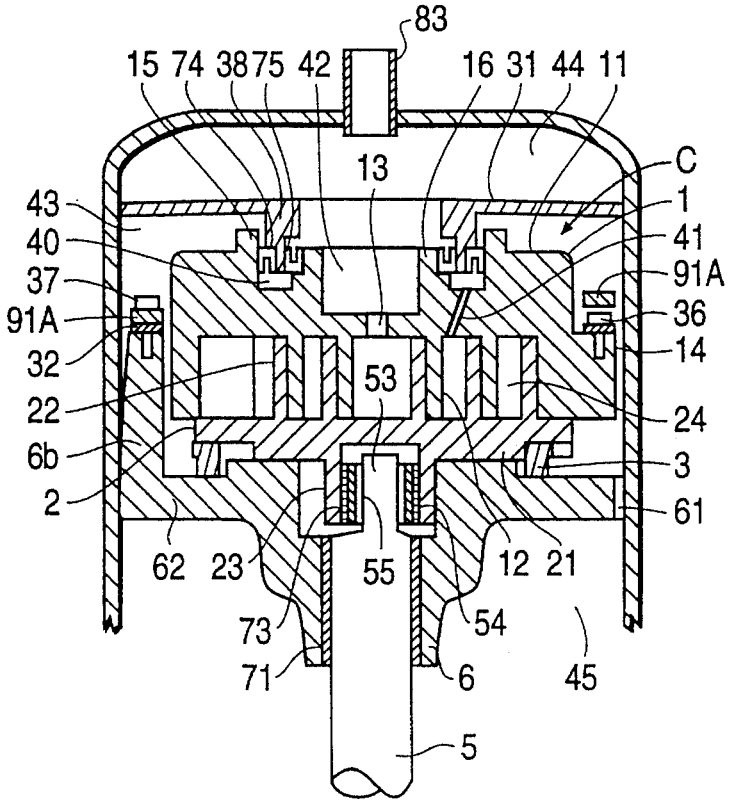
FIG. 4 is a vertical sectional view of the essential portion of a fifth embodiment of a scroll compressor according to the present invention.
Figure 5:
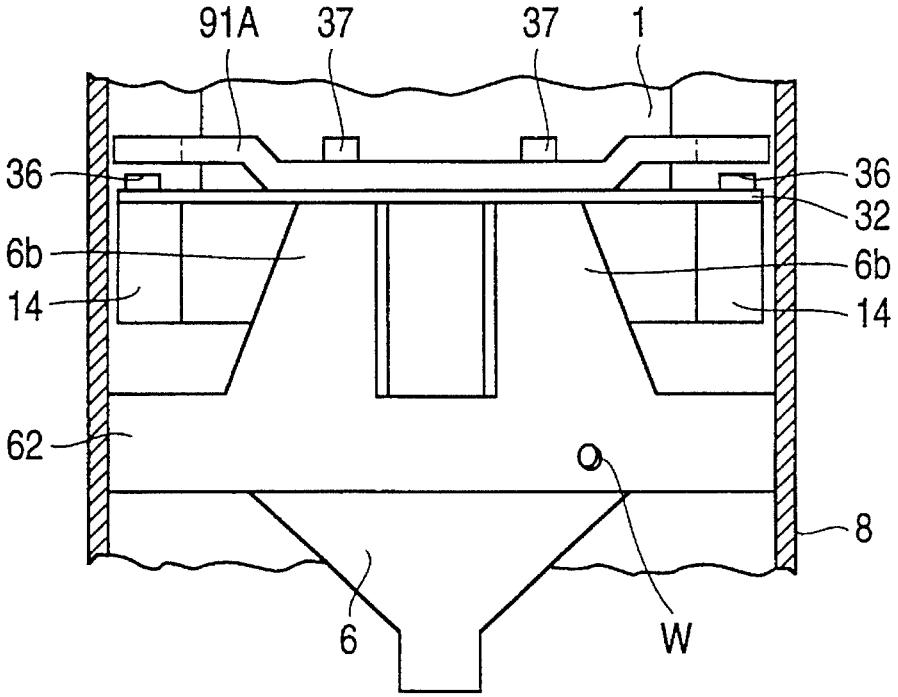
FIG. 5 is a front view of the essential portion of the scroll compressor shown in FIG. 4.
Figure 6A:
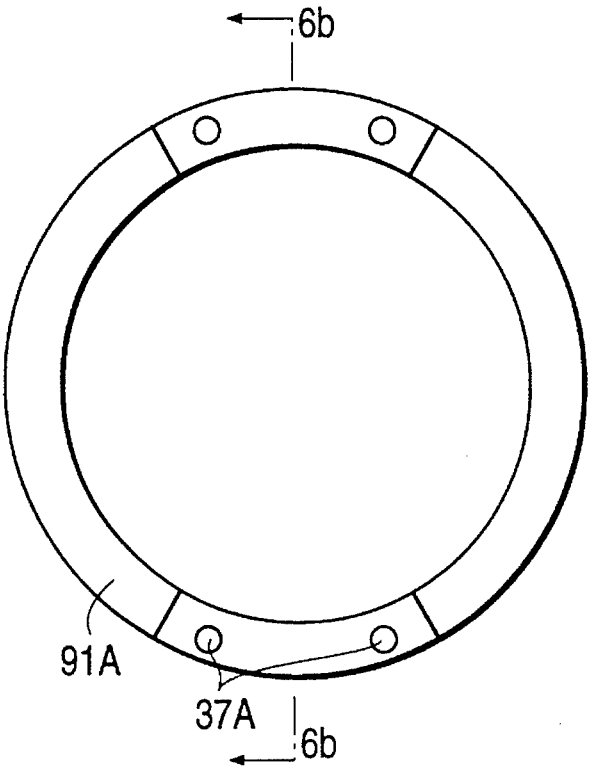
FIG. 6(*a*) is a plan view of a reinforcing plate used in the embodiment shown in FIG. 5.
Figure 6B:
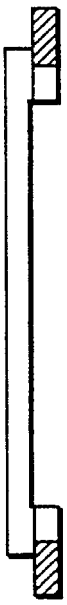

FIG. 4 is a vertical sectional view of the essential portion of a fifth embodiment of a scroll compressor according to the present invention and FIG. 5 is a front view of the essential portion of the compressor shown in FIG. 4. In these figures, reference numeral 91A designates a ring-like thick reinforcing plate having a sufficient rigidity and fastened to the leg 6*b* by means of bolts 37 (a total of four) through a support spring 32. FIG. 6(*a*) is a plan view of the above-mentioned reinforcing plate 91A and FIG. 6(*b*) is a sectional view taken along 6*b*—6*b* line of FIG. 6(*a*). In these figures, reference numeral 37*a* designates a hole through which a bolt 37 passes. The reinforcing plate 91A is so shaped that a portion of the plate 91A that passes over the flange of the stationary scroll 1 may float up lest the function of the support spring 32 should be impaired.

Figure 12:
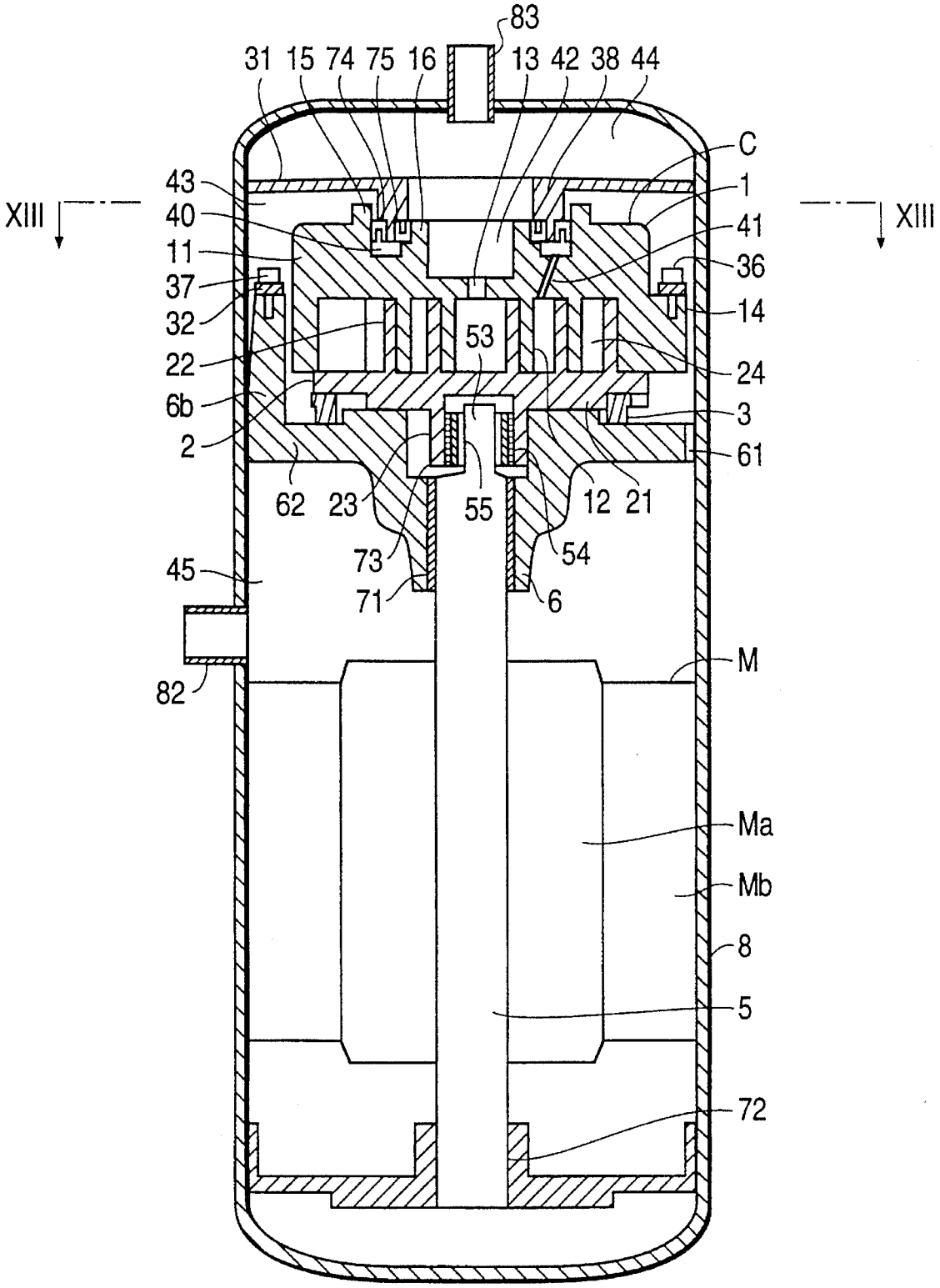
FIG. 12 PRIOR ART
FIG. 12 is a vertical sectional view of a conventional scroll type compressor.
Figure 13:
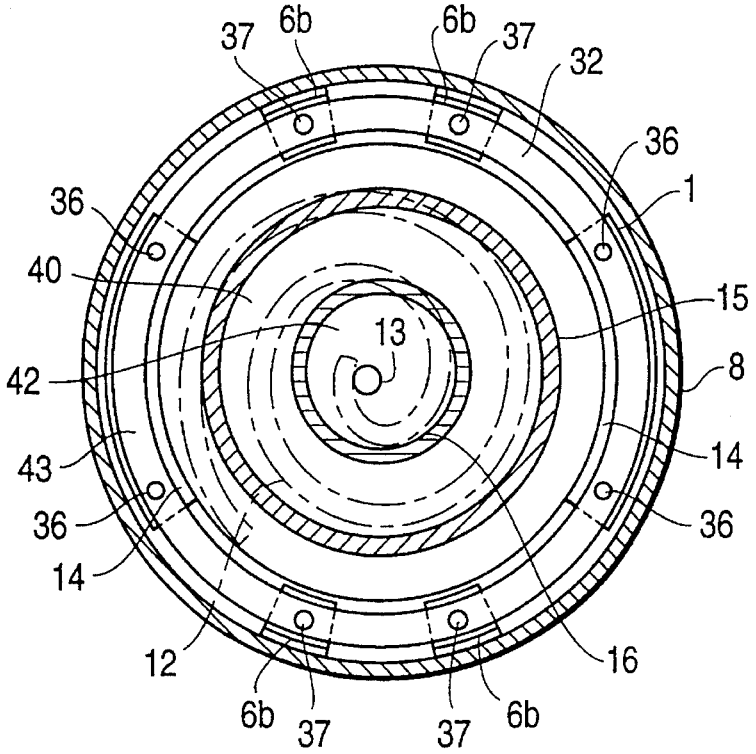
FIG. 13 PRIOR ART
FIG. 13 is a sectional view taken along line XIII—XIII of FIG. 12.

With the above structure, the leg portion of the frame 6 is a rigid frame comprising the two legs 6*b*, an end plate 62 of the frame 6 and the reinforcing plate 91A. Accordingly, the top end of the leg 6*b* will deflect little. Consequently, horizontal displacement of the stationary scroll 1 is inhibited and the gap between the fitting surfaces of the cylindrical flanges 15, 16 and the cylindrical flange 38 will not vary so that no excessive load acts on sealing members 74 and 75. The other structure and operation are the same as those of the conventional compressor shown in FIGS. 12 through 14 and like parts are designated by like reference numerals.

Figure 7:
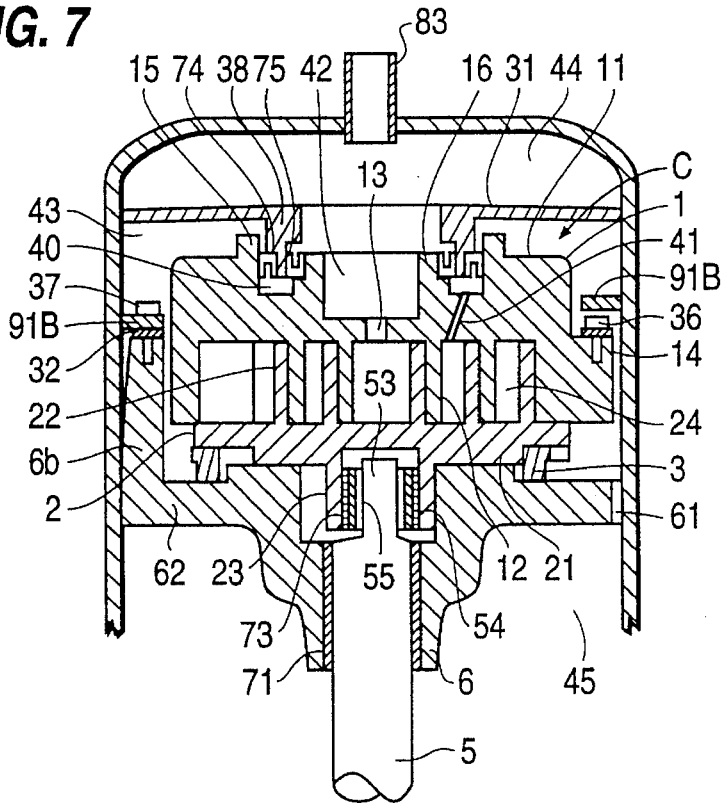
FIG. 7 is a sectional view of the essential portion of a sixth embodiment of a scroll compressor according to the present invention.

FIG. 7 is a vertical sectional view of the essential portion of a sixth embodiment of scroll compressor according to the present invention. In the figure, reference numeral 91B designates a ringlike thick reinforcing plate having a sufficient rigidity and which is lightly press-fitted into the sealed housing 8. Further, the reinforcing plate 91B is fastened to the leg 6*b* through the support spring 32 by means of bolts 37 (a total of four). The shape of the reinforcing plate 91B is substantially the same as the reinforcing plate 91A (FIG. 6) in the fifth embodiment but as described above, the outer diameter of the reinforcing plate is made very slightly larger than the inner diameter of the housing. Further, in the fifth embodiment, the portion of the reinforcing plate 91A that passes over the flange 14 of the stationary scroll 1 is so shaped that it may float upward.

With the above structure, because the top end of the leg 6*b* is supported by the inner surface of the sealed housing 8 through the reinforcing plate 91B lightly press-fitted into the sealed housing 8, no deflection of the top end of the leg 6*b* takes place. Accordingly, the horizontal displacement of the stationary scroll 1 is suppressed resulting in no significant change in the gap between the fitting surfaces of the cylindrical flanges 15, 16 and the cylindrical flange 38, whereby no excessive compression load acts on the sealing members 74 and 75. The other structure and operation are the same as those of the conventional compressor.

Figure 8:
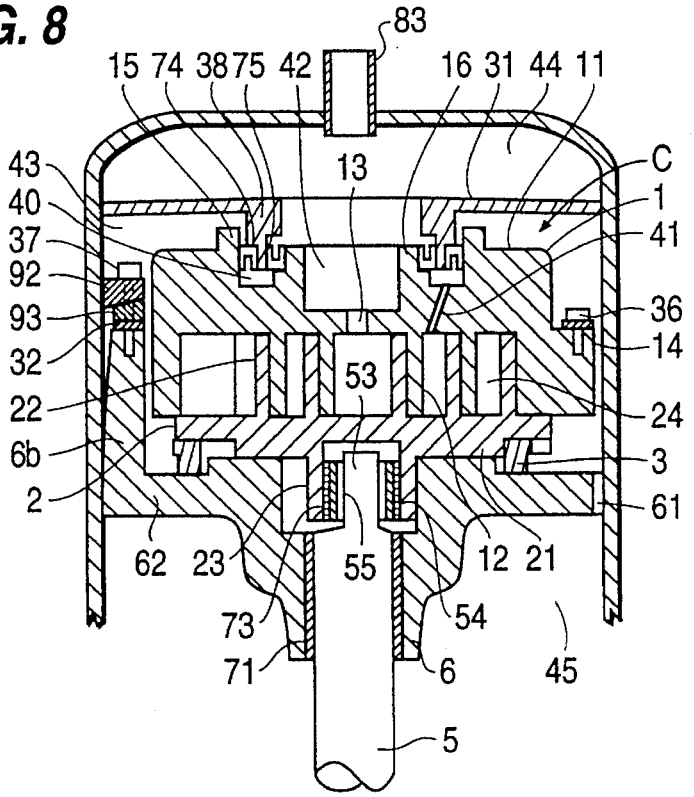
FIG. 8 is a sectional view of a seventh embodiment of a scroll compressor according to a seventh embodiment of the present invention.

FIG. 8 is a vertical sectional view of the essential portion of a seventh embodiment of a scroll compressor according to the present invention. In the figure, reference numeral 92 designates an upper clamp member having an inclined lower surface and reference numeral 93 designates a lower clamp member having an inclined upper surface mating with that of the upper clamp member. The upper and lower clamp members 92 and 93 are fastened to each of the four legs 6*b* through the support spring 32 by means of the bolts 37.

Figure 9A:
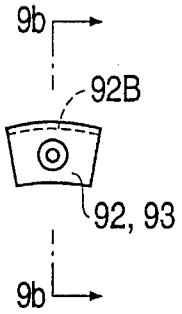
FIG. 9(*a*) is a plan view of a clamp member used in the seventh embodiment of the present invention.
Figure 9B:
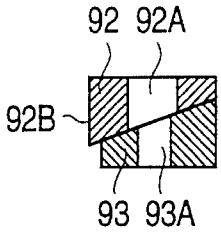

FIG. 9(*a*) is a plan view of a combination of the upper and lower clamp members 92 and 93 shown in FIG. 8 and FIG. 9(*b*) is a sectional view taken along line 9*b*—9*b* of FIG. 9(*a*). As shown, the upper clamp member 92 and the lower clamp member 93 have inclined surfaces at which they are brought into contact with each other. When the bolt 37 is fastened, the upper clamp member 92 slides outwardly along its inclined surface and its circular arc-shaped surface 92B is held in close contact with the inner surface of the sealed housing 8. Further, it is noted that the diameter of a hole 92A of the upper clamp member 92 is larger than that of a hole 93A of the lower clamp member 93 as shown in FIG. 9(*b*). The remaining portions are the same as those of the conventional compressor.

Figure 10A:
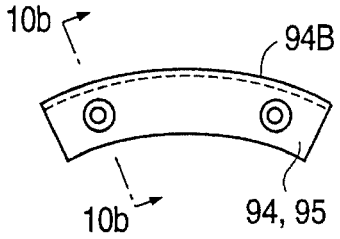
FIG. 10(*a*) is a plan view of a clamp member used in a eighth embodiment of the present invention.
Figure 10B:
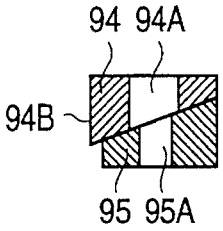

FIG. 10(*a*) is a plan view of an eighth embodiment of the present invention showing a combination of the upper and lower clamp members 94 and 95 which are made up of an integral pair of the upper clamp members 92 and an integral pair of the lower clamp members 93, respectively, used in the seventh embodiment of the present invention. FIG. 10(*b*) is a sectional view taken along line 10*b*—10*b* of FIG. 10 (*a*).

In this eighth embodiment, in order to allow the upper clamp member 94 to slide outward along its inclined surface with respect to the lower clamp member 95 so that the arc-shaped surface 94B of the member 94 is brought into close contact with the inner surface of the sealed housing 8, it is necessary to fasten two bolts 37 simultaneously which results in making the assembling operation difficult but this arrangement has the advantage of reducing the number of parts.

Figure 11A:
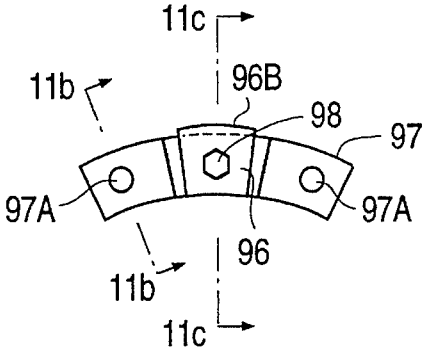
FIG. 11(*a*) is a plan view of a clamp member to be used in an ninth embodiment of the present invention.
Figure 11B:
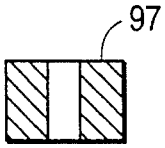
Figure 11C:
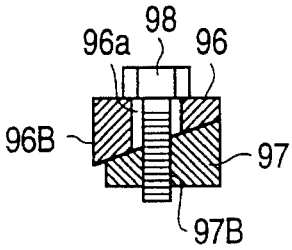

FIG. 11 (*a*) is a plan view of a ninth embodiment of the present invention showing a combination of an upper clamp member 96 and a lower clamp member 97, FIG. 11(*b*) is a sectional view taken along line 11*b*—11*b* of FIG. 11(*a*) and FIG. 11(*c*) is a sectional view taken along line 11*c*'—11*c* of FIG. 11(*a*). This ninth embodiment aims at facilitating the assembling operation. Although the lower clamp member 95 (FIG. 10) in the eighth embodiment has its entire upper surface inclined, the lower clamp member 97 in the instant embodiment has only the central portion of its upper surface inclined with a threaded hole 97B tapped in the center of the surface. Further, the upper clamp member 96 having the mating inclined surface and a fastening bolt 98 are combined with each other.

In the instant embodiment, the lower clamp member 97 is first clamped to the two legs 6B by the bolts 37 through the support spring 32 and then the upper clamp member 96 is clamped to the lower clamp member 97 by the bolt 98. In the clamping step using the bolt 98, the arc-shaped surface 96B of the upper clamp member 96 is brought into close contact with the internal surface of the sealed housing 8.

In the seventh through ninth embodiments, because the top ends of the four legs 6*b* are supported by the inner surface of the sealed housing 8 through the upper clamp members 92, 94 or 96 which are held in close contact with the inner surface of the sealed housing 8, no deflection thereof takes place. Consequently, the horizontal displacement of the stationary scroll 1 is inhibited which results in allowing very little variations to occur in the gaps between the cylindrical flanges 15, 16 and the cylindrical flange 38. Therefore, no excessive compression load acts on the sealing members 74 and 75. The structure and operation of the remaining parts of the machine are the same as those of the conventional compressor.

In summary, the embodiments of the scroll type machines according to the present invention have the following features, respectively:

(1) the frame has its legs plug-welded to the sealed housing at a plurality of points lying along the inner circumference of the frame;

(2) the frame has its legs plug-welded to the sealed housing at a plurality of points lying along the inner circumference of the sealed housing and at a plurality of points lying along the outer periphery of the end plate of the frame;

(3) after the sealed housing is expanded by being heated under a high-frequency heating method etc., the frame with its legs is inserted into the sealed housing in that heated condition and then the sealed housing is cooled to contract;

(4) the frame with its legs is press-fitted into the sealed housing;

(5) the top ends of the legs of the frame are connected to one another with the reinforcing plate;

(6) the above-mentioned reinforcing plate is in the shape of a ring;

(7) the ringlike reinforcing plate is lightly press-fitted into the sealed housing and the top ends of the legs are fixed to the reinforcing plate;

(8) a set of upper and lower clamp members having inclined surfaces, respectively, capable of coming into sliding contact with each other are clamped to the top ends of the legs of the frame and in the course of this fastening, the upper clamp member is caused to slide outward along the inclined surface of the lower clamp member so that the upper clamp member is brought into close contact with the inner surface of the sealed housing.

Consequently, the deflection of the top ends of the legs of the frame does not take place or is completely suppressed to in turn inhibit or suppress the horizontal displacement of the stationary scroll, and the application of an excessive load on the sealing members for the intermediate pressure chamber is prevented thereby preventing the sealing members from being damaged.

What is claimed is:

1. A scroll machine comprising: a sealed housing; a discharge cover extending across the interior of said housing so as to divide the housing into a high-pressure side and a low-pressure side; a frame disposed in said housing, said frame having an end plate, and a plurality of legs extending upright on said end plate and spaced from one another along the outer circumference of the end plate; a stationary scroll disposed in the low-pressure side of said housing, said stationary scroll being attached to top ends of the legs of said frame remote from the end plate of said frame; a swivel scroll disposed in the low-pressure side of said housing in meshing engagement with said stationary scroll; a support spring through which said stationary scroll is attached to the top ends of the legs of said frame, said support spring having a resiliency that allows said stationary scroll to be displaceable relative to said frame in an axial direction; said stationary scroll and said discharge cover having respective parts sealingly engaged with one another, said respective parts defining an intermediate pressure chamber on a side of said stationary scroll opposite from said swivel scroll such that pressure generated in said intermediate pressure chamber tends to force said stationary scroll toward said swivel scroll; and a plurality of plug-welds fixing said frame to an inner circumferential surface of said sealed housing, said plug-welds being located at said legs of the frame so as to suppress or prevent deflection of said legs relative to the end plate of said frame in a direction perpendicular to the axial direction.

2. The scroll machine as claimed in claim 1, and further comprising an additional set of plug-welds also fixing said frame to the inner circumferential surface of said sealed housing, said additional set of plug-welds being located at a plurality of points, respectively, along the outer periphery of the end plate of said frame.

3. The scroll machine as claimed in claim 1, and further comprising a seal interposed between said respective parts of the stationary scroll and discharge cover that are engaged.

4. The scroll machine as claimed in claim 2, and further comprising a seal interposed between said respective parts of the stationary scroll and discharge cover that are engaged.

5. The scroll machine as claimed in claim 1, and further comprising a rotary shaft extending through the end plate of said frame and into driving engagement with said swivel scroll.

6. The scroll machine as claimed in claim 2, and further comprising a rotary shaft extending through the end plate of said frame and into driving engagement with said swivel scroll.

7. The scroll machine as claimed in claim 3, and further comprising a rotary shaft extending through the end plate of said frame and into driving engagement with said swivel scroll.

8. The scroll machine as claimed in claim 4, and further comprising a rotary shaft extending through the end plate of said frame and into driving engagement with said swivel scroll.

* * * * *

UNITED STATES PATENT AND TRADEMARK OFFICE

CERTIFICATE OF CORRECTION

PATENT NO. : 5,547,355

DATED : August 20, 1996

INVENTOR(S) : Kazuhide WATANABE et al.

It is certified that error appears in the above-identified patent and that said Letters Patent is hereby corrected as shown below:

On title page, item [75] change second inventor's last from "Takada" to --Takeda--.

Signed and Sealed this

Twelfth Day of November, 1996

*Attest:*

Bruce Lehman

BRUCE LEHMAN

*Attesting Officer*

*Commissioner of Patents and Trademarks*